US005244342A

United States Patent [19]

De Dompierre

[11] Patent Number: 5,244,342

[45] Date of Patent: Sep. 14, 1993

[54] DEVICE FOR INTERCEPTING SHEETS BEING DISPOSED IN A PILE FROM A MACHINE FOR PRODUCING BLANKS FOR PACKAGES

[75] Inventor: Jean-Bernard De Dompierre, Echandens, Switzerland

[73] Assignee: Bobst SA, Switzerland

[21] Appl. No.: 691,978

[22] Filed: Apr. 26, 1991

[30] Foreign Application Priority Data

Apr. 26, 1990 [CH] Switzerland ..... 01420/90

[51] Int. Cl.[5] ..... B65H 31/32

[52] U.S. Cl. ..... 414/790.8; 271/218

[58] Field of Search ..... 74/52; 414/790.8; 271/218; 475/331

[56] References Cited

U.S. PATENT DOCUMENTS

| | | | |
|---|---|---|---|
| 3,233,891 | 1/1963 | Denton et al. | 271/218 |
| 4,189,270 | 2/1980 | Ehrlich | 414/790.8 |
| 4,359,218 | 11/1982 | Karis | 271/218 |
| 4,515,025 | 5/1985 | Missio et al. | 74/52 |
| 4,541,763 | 9/1985 | Chandhoke et al. | 414/790.8 |

FOREIGN PATENT DOCUMENTS

| | | | |
|---|---|---|---|
| 1611776 | 12/1971 | Fed. Rep. of Germany . | |
| 0055064 | 3/1986 | Japan | 414/790.8 |
| 359593 | 2/1962 | Switzerland . | |

*Primary Examiner*—David H. Bollinger
*Assistant Examiner*—Carol Wallace
*Attorney, Agent, or Firm*—Hill, Steadman & Simpson

[57] ABSTRACT

A device having a movable grid mounted on a movable carriage to temporarily intercept sheets being deposited from a machine for processing the sheets being discharged into a pile from a machine for processing the sheets includes an arrangement of a planetary system comprising a pinion movable in a circular arc coacting with a rim gear rigidly mounted on a frame and an arrangement for connecting the pinion to the carriage so that as the pinion rotates in the circular arc, the carriage is shifted between a retracted position and a second position for intercepting the sheets being deposited in pile. The device is particularly useful in a delivery station for a machine for die cutting package blanks in sheets of material.

8 Claims, 3 Drawing Sheets

DEVICE FOR INTERCEPTING SHEETS BEING DISPOSED IN A PILE FROM A MACHINE FOR PRODUCING BLANKS FOR PACKAGES

BACKGROUND OF THE INVENTION

The present invention is concerned with a device which is used in a machine for processing sheet shaped workpieces such as by cutting, creasing or printing to convert these workpieces into blanks for packages which the machine discharging each of the processed sheets one after another into a pile with the device of the present invention including a fixed part mounted in a frame of the machine and a movable part or carriage having a fork-like configuration and being movable relative to the fixed part between a first position withdrawn from the path of the sheets forming the pile to a second position catching sheets being deposited on the pile to allow a previously formed pile of the sheets to be removed and an arrangement or means for shifting the carrier between the two positions.

As illustrated in FIG. 3, a device can be used for instance in so-called sheet delivery stations situated at the outlet or subsequent to a cutting press. As illustrated, the machine has a press P1 and sheets F gripped on a leading edge by a gripper bar B1 which is mounted on a pair of chains C3 is carried between the stations and from the last station such as P1 to a discharge station to be laid one after another in a pile E1 of sheets. When the pile is full, the prior art device allows the pile to be quickly removed in the following manner. During a short lapse of time beginning with the last sheet being applied on the pile and before the next sheet, an intermediate grid 45 was shifted over the top of the pile to an extended position 45' (shown in broken lines) to catch the next sheet being deposited thereon. During this period of time, the full pile can then be removed out of the delivery station. For the pile build-up, the station was equipped with a pile carrier provided with a movable table T1 having the shape of a vertically movable grid. With the view to insure a controlled delivery of the sheets, when the pile commences to build-up, the table T1 is lowered with each additional sheet arriving so that the upper level of the pile E1 will remain steady. It should be noted, in this discussion that the term sheets could also be the individual blanks in the event the delivery station is from a blank separator which would separate the linked together blanks of each sheet into individual blanks. For easy removal of the pile, the movable table T1 is mounted on an upper end of a vertical stay of shaft M1 which extends between two conveyor belts C1. As soon as the pile is full, the intermediate grid 45 is shifted to the extended position 45' to catch the next sheet as the vertical shaft lowers the movable table T1 downward till the lower most sheet of the full pile which is now pile E2 onto belts C1 to be removed in a direction toward the belt C2. After the belts C1 have moved the pile E2 off the table T1, it is again raised upward to engage the bottom sheet of the new formed pile E1 which is being temporarily formed on the intermediate grid 45.

In order to replace the support of the intermediate grid 45 by the support of the table T1, the prior art device has the grid elements of the table T1 pass between grid elements of the grid 45 to a position such as illustrated in dashed lines at T1'. In reality, the intermediate grid can be formed as a fork having prongs which form the supporting elements that will extend between the openings in the grid forming the table T1. Thus, once the table T1 assumes the position illustrated at T1', the pile E1 is lifted to allow the retraction and removal of the fork forming the intermediate grid 45. It should be pointed out, that this arrangement enables a removal of a pile without stopping the machine.

Other arrangements which are designed to intercept sheets as they are being laid down on top of a pile are disclosed in both Swiss Patent 359593 and German 1611776. In these designs, instead of an intermediate rigid grid, a flexible screen is unrolled over the pile allowing thus a new pile to be temporarily built up on the flexible screen as the pile therebelow is removed. As soon as the full pile underneath the flexible screen has been removed, the flexible screen is then rolled in backwards in order to be removed from underneath the new pile so that the new pile will then be able to take up a position on the vertical movable table like in the one described hereinabove.

Whether a rigid grid or flexible screen is used, their forward and backward movement have always been achieved up to now essentially by means of motor driven chains. However, on account of the relatively large range or distance to be covered which may be as large as 1200 millimeters and in view of the high speeds of production which will require the grid and screen movement of speeds up to 6 meters per second, the drive systems using such a chain design for moving forward and backwards are not only difficult to adjust but are a source of problems due to the chain breaking. Since the stopping and retraction cannot be easily controlled at the required points, it is also inaccurate.

SUMMARY OF THE INVENTION

The object of the present invention is to provide an improvement that will eliminate the above mentioned shortcomings. This object is obtained by an improvement in a device for temporarily intercepting and collecting sheets being disposed in the pile for a processing machine which processes sheet shaped workpieces by cutting, creasing, printing to form blanks for forming packages and in which machine the process sheets are deposited in a pile, said device including a fixed part fitted on a frame of the machine as well as a movable carriage provided with a fork-shaped support able to take up a first position in which said support is located on a side of the pile being formed and a second position in which said support is located above the pile and thus intercepts sheets being deposited thereon in order for a full pile therebelow to be removed, means for shifting the movable part between the first to the second position and means for guiding the movable part with regard to the fixed part. The improvements are that the means for shifting include a horizontal rim with inner teeth being mounted on the fixed part, a movable pinion having teeth permanently engaged on the inner teeth of the rim and having a number of teeth which is equal to half the number of teeth on the rim, first means for shifting the pinion so as to have its axis describe a circular arc centered on an axis of the rim and means for linking the pinion to the movable part so that as the pinion moves along said circular arc, it will cause the movable part to be shifted between the first to the second positions.

Other advantages and features of the invention will be readily apparent from the following description of the preferred embodiments, the drawing and claims.

DESCRIPTION OF THE PREFERRED EMBODIMENT

As illustrated in the figures, this sheet intercepting device includes a fixed horizontal rectangular frame which is formed by two lateral plates 10 and 10', a crosswise end plate 11*a* and profile cross pieces 11*b*–11*h*. The plates 10 and 10', 11*a* as well as the profile pieces 11*b*–11*h* are all assembled at their ends by means of screws 12.

Figure 1:
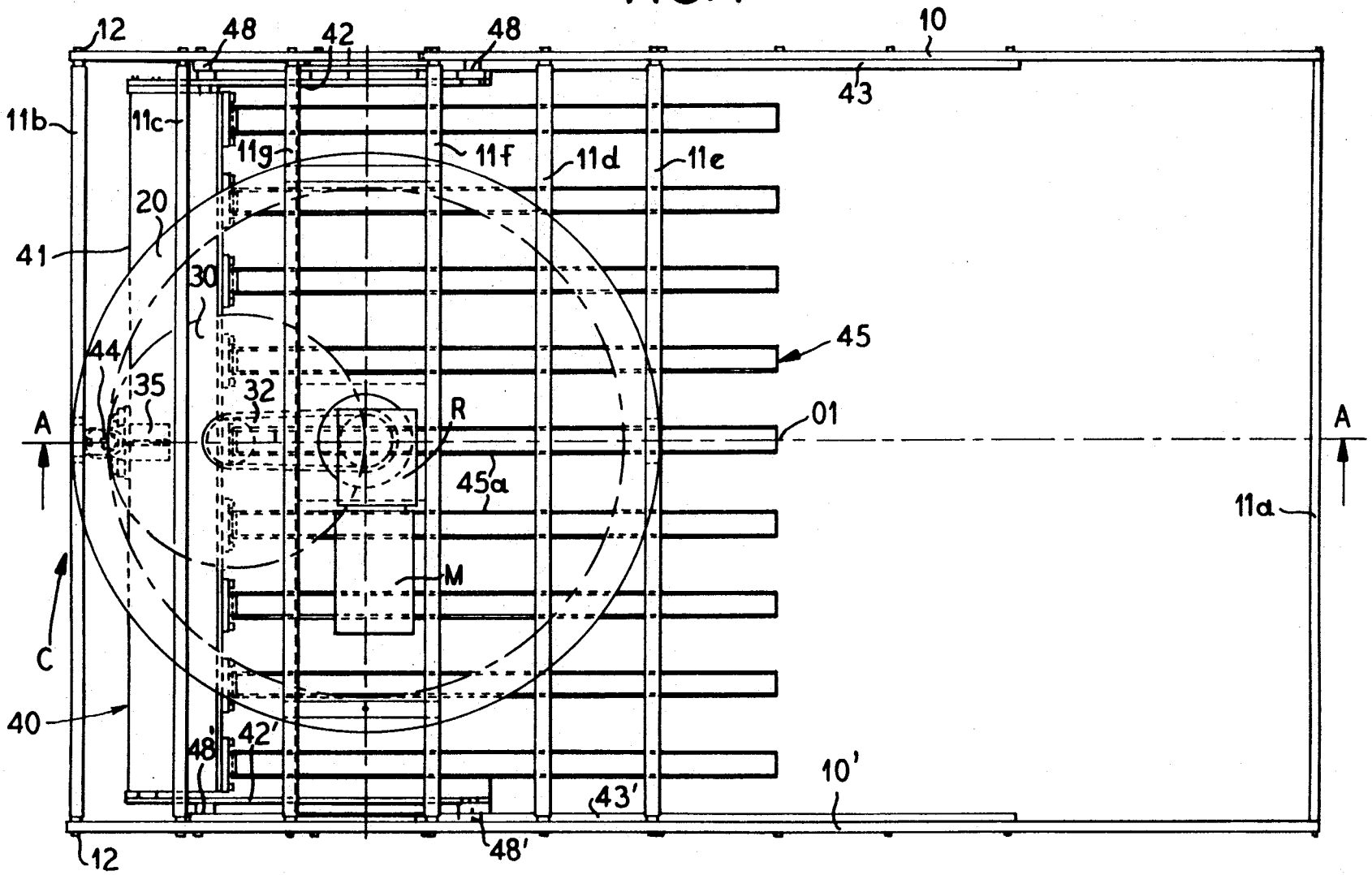
FIG. 1 is a top plan view with portions removed for purposes of illustration of a device according to the present invention.
Figure 2:
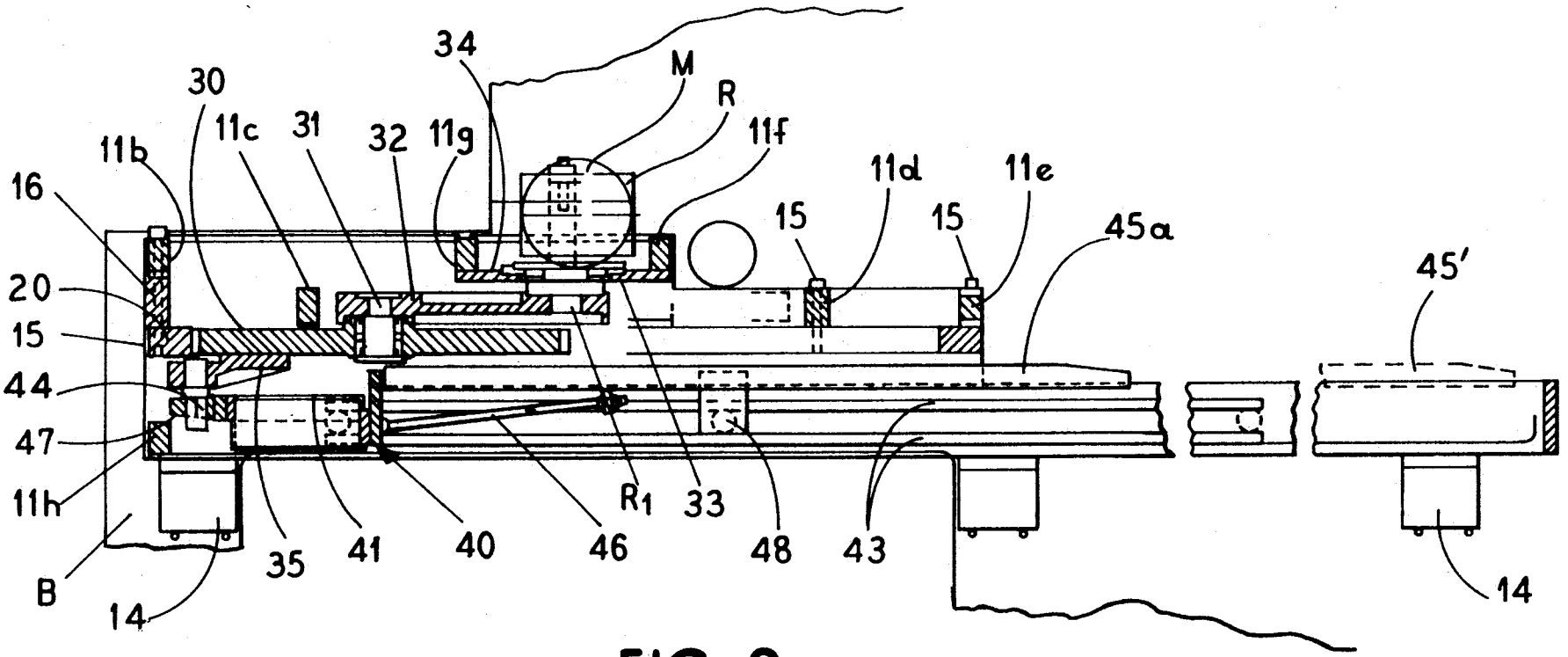
FIG. 2 is a cross-sectional view taken along lines A—A of FIG. 1.

As is shown in FIG. 1, the sheets are delivered from an upstream station situated on the right-hand side for instance from a waste stripping station of a cutting machine. The measurements of the frame C are sufficiently large so as to enable the lateral plates 10 and 10' to be on either side of a pile to be built up. The frame C on its four ends (see FIG. 2) is provided with corner pieces 14 for fastening the frame C on the frame B of the machine. On the left-hand end of the frame C, which is the farthest end from the pile, a large rim 20 with an inner annular surface with inwardly facing on inner teeth is mounted horizontally and fastened by means of screws 15 on the undersides of profile pieces such as 11*c*, 11*d* and 11*e*. For construction reasons, cross members or filler members 16 are fitted between the rim 20 and each of the profile pieces 11*b*, 11*g* and 11*f*. A movable pinion 30 with half the number of teeth as compared to the number of teeth on the interior or inner annular surface of the rim 20 is mounted on the inside of the rim 20 to engage teeth of this rim. The pinion 30 is mounted for free rotation on a stud or pin 31 (best illustrated in FIG. 2) which is fitted or mounted on a first end of a horizontal lever 32 whose other end is mounted on a vertical outlet shaft R1 of a reduction gear R which itself is connected to a motor M. An assembly consisting of the reduction gear R and the motor M is mounted by screws such as 33 on a plate 34 (see FIG. 2) welded on a lower side of the two cross profile pieces 11*g* and 11*f*. It should be noted for purposes of illustration and a clear understanding of the invention, the plate 34 is not shown in FIG. 1.

A carriage 40 is positioned beneath the rim 20 and can be moved horizontally left to right and back. The carriage 40 is formed by a crosswise profile piece or crosswise member 41 whose ends are provided with horizontal bars or lateral supports 42 and 42' which extend parallel to the corresponding lateral plates 10 and 10'. Every bar 42, 42' is provided with two rollers 48, 48' which are held within guiding grooves which are formed by two bars 43, 43' which are mounted on the interior surfaces of the lateral plates 10 and 10'. To form the fork-like support or tray 45 a plurality of channel shaped, horizontally extending pieces or members 45*a* are provided and are mounted at one end on the member 41 to be in a cantilever type arrangement. To provide additional support for each of these members 45*a*, a brace such as 46 (see FIG. 2) can be provided.

The center of the crosswise profile piece 41 carries a vertical stud 44 for free rotation by means of a bearing 47. An upper end of the stud 44 is received in a fixture 35 which is mounted on a lower side of the pinion 30. As illustrated in FIG. 1, the carriage 40, while in its left-hand position will have the channel shape pieces 45*a* fully outside of the pile top area where they are unable to intercept the sheets. At this stage, the two studs 44, 31 and the rotational axis of the vertical shaft R1 are located on the same straight line for example a central axis O1 of the machine and the stud axial or pin 44 is positioned on a tangential point of the pinion 30 with regard to the rim 20. When the lever 32 is rotated for instance in a clockwise direction by the shaft R1, which in turn is driven through the reduction gear by the motor M, the response of the rim held in a fixed position on the movable pinion 30 causes the movable pinion to rotate in a counter clockwise direction and a center or axis of the pinion will orbit the center of the rim and moves in a circular arc. Since the diameter of the pinion 30 is equal to half of the diameter of the rim 20, the stud or pin 44 will shift to the right following the central axis O1 and shift the carriage 40 which is guided by the rollers 48, 48' and the guides 43, 43'. The stroke to the right-hand side of the carriage will come to an end with the tangential point between the pinion 30 and the rim 20 being again on the central axis O1 through on the right-hand side of the rim 20 which is the second position for the carriage. At this moment, channel shaped members 45*a* move forward to their farthest point over the pile and are thus ready to intercept and temporarily collect any sheets being deposited from the delivery station.

At this stage, the motor will come to a stand still and the full pile E2, which is located beneath the channel members 45*a*, will be removed from the movable table T1 of the pile tray mentioned above. The table T1 is then raised until its supporting elements will come between the U-shaped pieces 45*a* in such a way as to lift any sheets supported thereon from the surface of these members. Then the motor M is switched on in order to have the carriage 40 moved towards the first mentioned position on the left side and thereby shift the tangential point back to the starting point on the left side of the rim 20 so that the U-shaped members 45*a* will be withdrawn from their extended position to a retracted position removed from the pile.

Obviously in order to reduce the inertia all profile pieces such as 41 and in the channels or U-shaped members 45*a*, which form the carriage 40, are to be formed of lightweight material for instance of an aluminum alloy.

Figure 3:
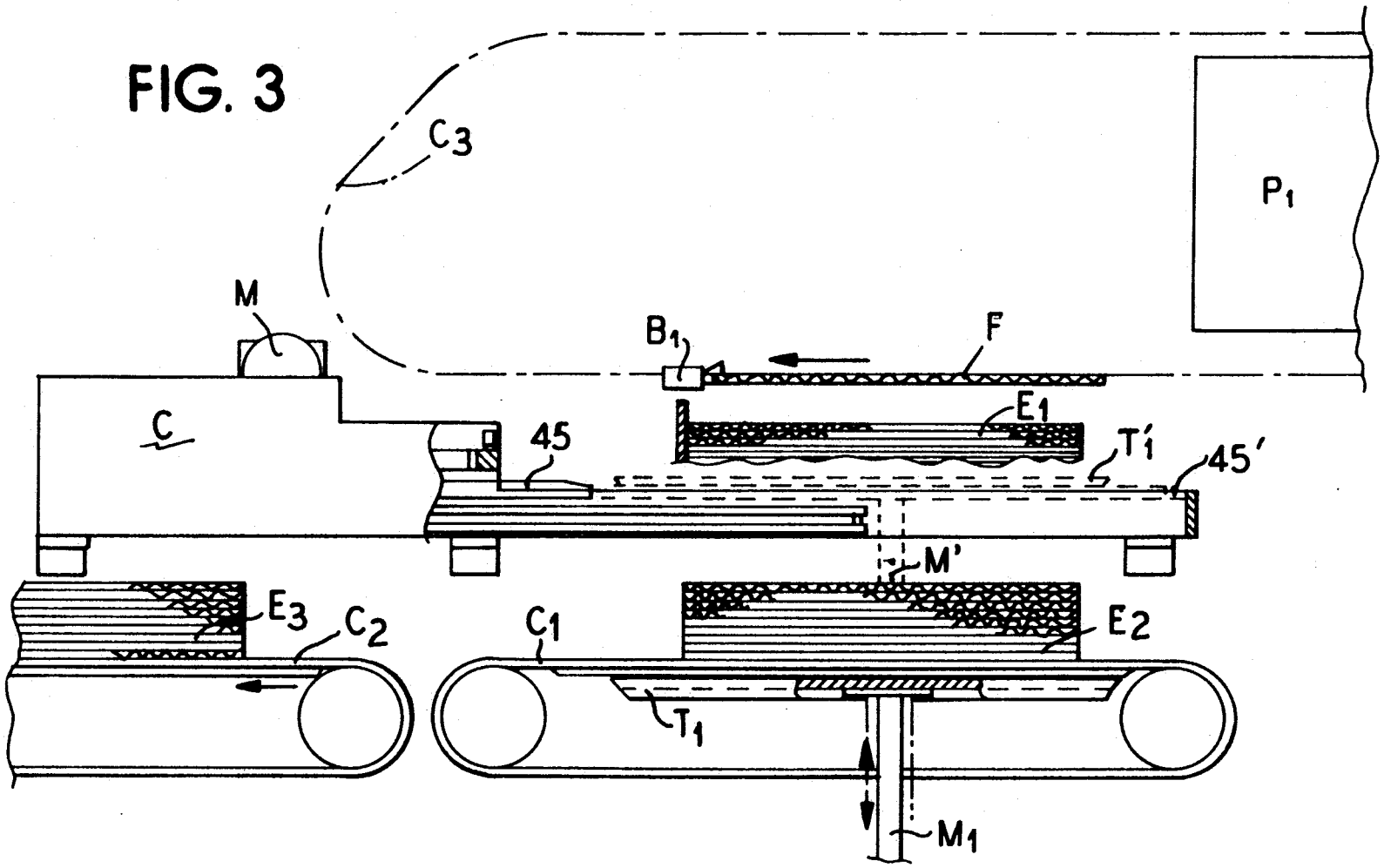
FIG. 3 is a partial side view with portions broken away for purposes of illustration of a sheet delivery station utilizing the device of the present invention.

As illustrated in FIG. 3, the frame C of the device is arranged beneath the point of return of the chain pairs C3 which carry the gripper bar B1 that grips the sheets front edges. On leaving the cutting press P1, the sheets F are moved on a point above the area where a pile E1 or E2 is to be formed. The pile E2 is a full pile just lowered onto the two carrier belts C1.

A pile E3 is being removed by the two belts C2. The intermediate grid 45 is shown in the first position which is removed from the area of the pile and is also shown in dashed lines in the second position 45' extended over the top area of the pile. While in the first position, the sheets F will be deposited on the top of the pile E2. In the very instance when the intermediate grid 45 is moved towards the second position illustrated at 45' and dashed lines, a new pile E1 is temporarily built up on this grid. When the pile E2 has been completely removed by the belt C1 onto the belt C2 and thereby out of the area of the table T1, the table can be raised to the position T1′ shown in dashed lines so as to be slightly above the plane of the intermediate grid 45 when in the second position to raise any portion of the pile E1 therefrom. At that stage, the intermediate grid can be moved to the first position shown in unbroken lines. After removal of the grid 45 back to the first retracted position, the table T1 will be progressively lowered with the height of the pile E1 increasing so that the pile top will permanently keep at a substantially steady level or position.

The device described above thus has the following advantages, there are no chain transmissions, there is a high positional accuracy at the stroke end of the carriage 40 in fact even a slight angular mis-position of the pinion 30 on the stroke end of the carriage 40, for example, if the point of tangential contact of the pinion 30 with the rim 20 is to be offset off of the central axis O1, it will only entail a slight linear mispositioning of the carrier 40. Another advantage, is the outstanding simplicity of the design which insures a quick and reliable operation.

Although the present invention has been described with reference to a specific embodiment, those of skill in the art will recognize that changes may be made thereto without departing from the scope and spirit of the invention as set forth in the appended claims.

I claim as my invention:

1. In a device for intercepting and temporarily collecting sheets being laid in a pile by a processing machine which processes sheet-shaped workpieces by cutting, creasing and printing them to convert the sheets into blanks for packages, said machine depositing the sheets in a pile, said device including a fixed part being mounted on a frame of the machine and a movable carriage provided with a fork-shaped support being mounted in the fixed part for movement between a first position with the fork-shaped support being retracted from the place where sheets are being formed into a pile to a second position with the fork-shaped support being located above a pile to intercept the sheets, means for shifting the movable carriage from between the first and second positions and means for guiding the movable carriage with regard to the fixed part, the improvements comprising said means for shifting including a horizontal rim with an inner annular surface with a fixed number of teeth being mounted on the fixed part, a movable pinion having a pinion axis and a number of teeth which is equal to one half of the fixed number of teeth of the rim, first means for mounting the pinion with the teeth of the pinion being in permanent engagement with the teeth of the rim, said first means shifting the pinion so as to have the pinion axis form a circular arc on a center of the axis of the rim and means for linking the pinion to the movable carriage so that as the pinion is shifted along the circular arc, it will cause the movable carriage to be shifted between the first and second positions.

2. In a device according to claim 1, wherein the first means for mounting the pinion include a horizontal lever having one end mounting the pinion for rotation and another end fixed on a vertical shaft centered on the axis of the rim, and means insuring the rotation of said vertical shaft so that the axis of the pinion will describe said arc.

3. In a device according to claim 2, wherein the means for insuring the rotation is a motor connected to a reduction gear and said vertical shaft is an outlet shaft of said reduction gear.

4. In a device according to claim 3, wherein the means for shifting the movable carriage is achieved in a direction extending parallel to a central axis of the machine and includes that the axis of the rim is located on the central axis and that the first and second positions of the movable carriage are determined by two positions of the pinion in which the tangential contact point with the rim is also located on said central axis.

5. In the device according to claim 4, wherein the fixed part consists of rectangular frame situated on the pile side opposite to the sheet arrival side and being made up of lateral members and crosswise bars, said rim being situated on a side of the frame farthest from the pile so that the first and second positions mentioned for the carriage will correspond to the farthest and respectively closest positions of the pinion with regard to the pile.

6. In a device according to claim 1, wherein the movable carriage comprises a crosswise member provided with the means for linking the movable carriage to the pinion and several horizontally extending pieces each having one end mounted on the crosswise member to extend in a cantilever manner essentially towards the pile and essentially parallel to a central machine axis.

7. In a device according to claim 6, wherein the fixed part is a rectangular frame with lateral sides, and wherein the means for guiding include rollers fitted on lateral supports mounted on the ends of said crosswise member of the carriage, said rollers being received in corresponding guides which are formed on said lateral sides of said rectangular frame.

8. In a device according to claim 7, wherein the horizontally extending pieces have a channel shape and consist of an aluminum alloy.

* * * * *